United States Patent [19]

Willis

[11] 4,098,540

[45] Jul. 4, 1978

[54] ROLLER SKATE WHEEL HAVING A DEFLECTING OUTER EDGE

[76] Inventor: Robert R. Willis, 15 Standish Ave., Barrington, R.I. 02806

[21] Appl. No.: 799,999

[22] Filed: May 24, 1977

Related U.S. Application Data

[63] Continuation-in-part of Ser. No. 691,348, Jun. 1, 1976, abandoned.

[51] Int. Cl.[2] ..... A63C 17/22

[52] U.S. Cl. ..... 301/5.7

[58] Field of Search ..... 301/5.3, 5.7; 280/63 PW, 87.04 A, 11.19, 11.28; 152/7, 324, 323, DIG. 18; 16/45–48; 308/16, 191, 210; D34/15 AJ, 14 C; D12/134–135, 204, 207–208

[56] References Cited

U.S. PATENT DOCUMENTS

| | | | |
|---|---|---|---|
| 353,644 | 11/1886 | Root | 301/5.7 |
| 2,262,714 | 11/1941 | Ware | 301/5.3 |
| 2,664,317 | 12/1953 | Glynn et al. | 301/5.3 |
| 2,863,701 | 12/1958 | Jones et al. | 301/5.7 |
| 3,387,894 | 6/1968 | Louik | 301/63 PW |
| 3,883,180 | 5/1975 | Kain | 301/5.3 |
| 3,905,649 | 9/1975 | Kosono et al. | 301/5.7 |
| 3,992,025 | 11/1976 | Amelio | 301/5.7 X |

*Primary Examiner*—Stanley H. Tollberg
*Assistant Examiner*—Charles A. Marmor
*Attorney, Agent, or Firm*—Barlow & Barlow

[57] ABSTRACT

A roller skate wheel is disclosed having a plastic body portion with a central axial bore into which is received precision bearing units. The bearing units are received on the axle of a wheel truck and the wheel is provided with a substantial outward overhanging portion from the bearings which is formed with a series of tapered counterbores, which provide superior gripping of the surface on which the wheel engages.

3 Claims, 5 Drawing Figures

ROLLER SKATE WHEEL HAVING A DEFLECTING OUTER EDGE

CROSS REFERENCE TO RELATED APPLICATION

This application is a continuation-in-part of my earlier filed application Ser. No. 691,348, filed June 1, 1976, now abandoned.

BACKGROUND OF THE INVENTION

Roller skate wheels historically were made from metal or wood. In an effort to secure superior roller action of the wheel, the use of precision bearings has been previously suggested as in U.S. Pat. Nos. 2,607,010, 2,734,777 and 3,860,293. In addition, the art has developed to a point where plastics for the wheel structure are becoming more and more common. Examples of plastic prior art wheel constructions are shown in U.S. Pat. Nos. 2,863,701 and 3,311,417. When skateboards became popular, the wheels were called upon to support double the load that has been experienced in roller skate wheel constructions and further the wheels were called upon to provide traction on standard roadbeds or highways. This provided an apparently different environment for the wheel to operate in than was common on hardwood floor roller skating rinks, and the wheels that were utilized were molded from a urethane, a thermoplastic material and rather inexpensive loose ball bearings were provided, much like the structure shown in U.S. Pat. No. 2,863,701. In the use of this type of wheel it was found that the bearings would not stand the loads that were placed thereon and furthermore the tracking ability of the molded wheels was found in some instances to be inferior so that control of the skateboard was lost. This is particularly so when executing turns of a small radius where considerable slippage takes place between the rollers and the surface creating undesirable wear. The instant disclosure relates to a wheel structure where the wear on the periphery of the wheel is reduced by controlling the deflection parameter of the periphery of the wheel with a novel series of tapered counterbores and more particularly the tracking ability is superior since the wheel maintains substantial contact with the traction surface even when cornering.

It is accordingly a primary object of the present invention to provide for a skateboard a roller structure which is vastly superior to previously known roller structures designed for the same purpose.

In particular, it is an object of the invention to provide a roller structure, particularly for skateboards, which will have the capability of enabling a skateboard operator to execute turns in a manner which is far safer than has heretofore been possible while at the same time reducing slippage between the rollers and the surface on which they roll and increasing the life of the rollers as compared to conventional rollers.

It is especially an object of the present invention to provide for a skateboard or the like rollers which are capable of increasing their traction with respect to the surface on which they roll when executing turns.

Also, the objects of the present invention include the provision of a skateboard and a roller construction to be used therewith which while being of relatively low cost nevertheless are capable of achieving the above objects in a highly reliable manner.

SUMMARY OF THE INVENTION

The present invention provides a skate wheel construction where the wheel is preferably cast from a thermosetting plastic of the urethane family and which when cured will exhibit a hardness in the range of Shore A88 to A91. The wheel is provided with a central axial bore for the reception of the truck axle and which is mounted on the truck axle by a pair of spaced precision bearing units which may be of the ball bearing or roller bearing or needle bearing type. The bearing units are spaced apart by the construction of the bore itself and the fact that they are received in counterbores. The wheel is provided with a series of tapered counterbores which extend one side of the wheel so as to provide an overhang and which would normally face the end of the axle of the wheel truck. The counterbores are tapered on angles, the first of which subtends an angle on the order of 15° from the axis of the truck axle and the second counterbore subtends an angle of 60° from the axis of the truck axle. The result of the particular angles is one that has to be mated with the particular plastic being utilized so that a slope on the order of 6 to 8 is achieved with slope is a measure of the deflection to distance outwardly from the bearings, slope being defined as axial distance divided by deflection.

DESCRIPTION OF THE PREFERRED EMBODIMENT

Figure 1:
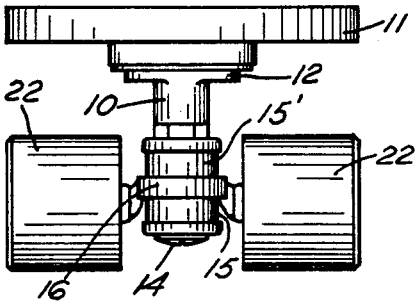
FIG. 1 is an elevational view of the wheel of my invention mounted on a truck.

Referring to FIG. 1 a partial skate wheel structure is illustrated comprising a sole plate member 10 which may be attached to a skateboard 11. The sole plate structure, which is cast with a boss 12, carries a support for a kingpin 14 that is threaded into the boss 12 and which between the resilient washers 15, 15' supports a hanger bracket 16 for the wheel truck, further support for the wheel truck being provided by the usual arm (not shown) interconnected with the sole plate by a ball and socket connection as is common in the art.

The above assembly has a pair of axles 20 extending either side of the support structure and these axles are adapted to receive at their outer ends wheels, one of which is illustrated in the drawings and designated 22. The wheel body is preferably made of a thermosetting material such as urethane and is cast with a central axial bore 24 that is concentric with the peripheral surface 25. Into opposite ends of the bore two counterbores 26 and 27 are formed and into these counterbores is press fitted precision bearing units 28 and 29 respectively. The bearing units 28 and 29 are of conventional form and broadly consist of inner and outer races, the outer race being frictionally received in the counterbores 26, 27 while the inner races are snugly but slidably received on the axle 20 and the inner bearing unit 28 has its inner race bearing against a lock washer 32 and the enlarged portion of the shaft defined by the shoulder 33, while the inner race of the bearing unit 29 bears against a securing nut 35. The inner races of the bearing units are separated by a spacer 30. In this way relative rotation between the inner and outer races is assured.

Figure 2:
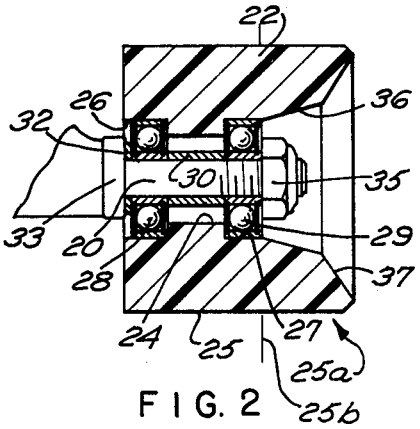
FIG. 2 is a cross sectional view of the wheel assembly.

The body of the wheel is formed as seen particularly in FIG. 2 with the outside edge portion thereof extending outwardly a distance from the outer bearing unit support provided by the bearing 29. This extended area is utilized to give increased traction on the surface on which the wheel engages and if one considers the area particularly outward of the outer edge of the counterbore 27, this particular section of the peripheral cylindrical surface, which I have generally designated **25*a* that extends outwardly from the section line 25*b* that begins at the outer end of the bearing is normally subjected to considerable deflection and the entire performance of the wheel is dictated by the manner in which this section performs. It has been found, for example, that if this section is extremely resilient, that on turns proper control of skateboards can be achieved but the wheel exhibits what is known to those users as a drag. Similarly if the section is unduly stiff and fails to exhibit proper resiliency, then through cornering friction loss results and extreme wear occurs on the outer peripheral section and the wheels have little longevity. The solution to the proper performance is achieved by utilizing a series of tapered counterbores, there being a first counterbore 36 which subtends an angle of approximately 15° to the axis of the main bore, joined to a second tapered counterbore 37 which subtends an angle of approximately 60° to the axis of the bore, together with providing cured plastic having or exhibiting a hardness of between Shore A88 to A91. The area 25*a*** with a construction of this nature exhibits a particular deflection characteristic wherein if one measures the deflection as related to distance, the slope will be substantially in the range of 6 to 8, the slope being defined by dividing axial distance by deflection.

Figure 4:
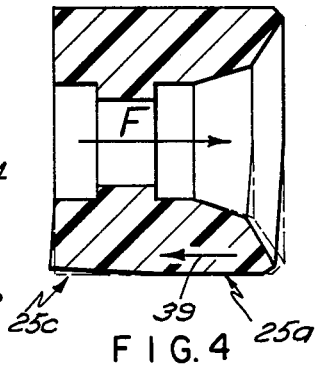
FIG. 4 is a diagrammatical representation of deformation of the wheel of my invention.

In particular, the action of the wheel can be seen in FIG. 4 where a force F is forcing the axle to the right as viewed in the drawing. In this situation which exemplifies an execution of a turn, the portion of the wheel contacting the road is distorted "unweighting" the innermost edge **25*c* and flattening the outer area 25*a* to give a substantially full area of contact. The flattening or distortion of the normal cross-section is a flowing of the plastic as seen by arrow 39**. Optimum deflection characteristics are achieved by the particular tapered bores which distribute the forces normal to the axis of the axle whereby each portion of the circumference of the wheel contacting the road surface provides maximum traction.

Figure 3:
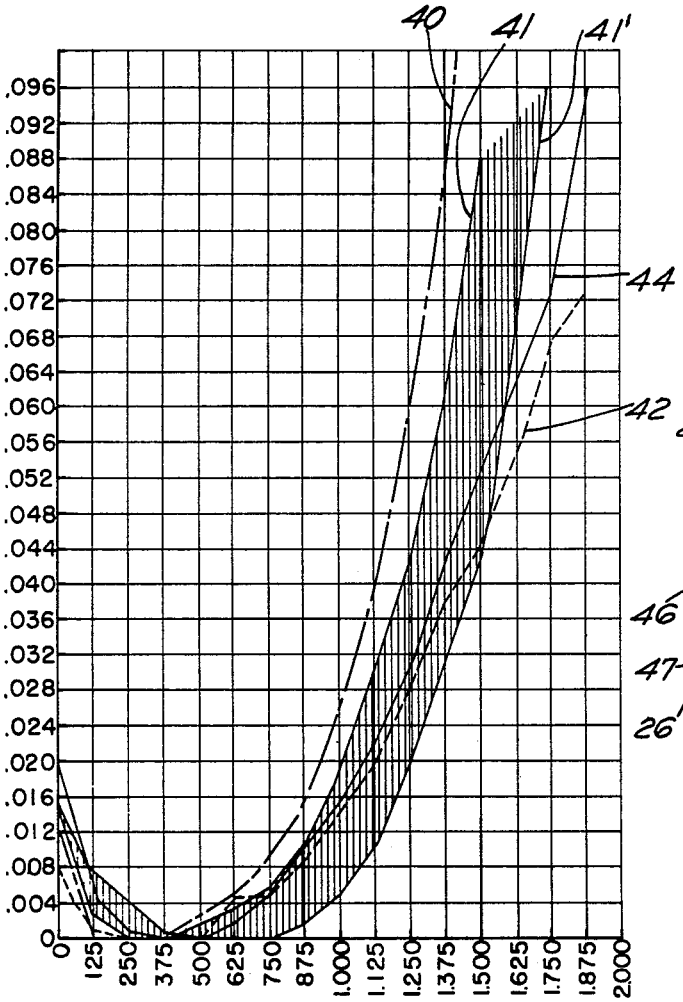
FIG. 3 is a graphical representation of the deflection experienced on molded plastic wheels of different designs taken from the inner to outer edge.

I have represented in FIG. 3, graphically, the various conditions which have been exhibited by wheel molded from plastic material having a hardness of Shore A89 and having a variety of constructions. For example, with a skate wheel where the area **25*a* has a counterbore which is substantially parabolic or a shape nearly parabolic as in U.S. Pat. No. 3,992,025 and a hardness of Shore A89, a curve such as 40 will be obtained. On the other hand if a wheel construction is molded substantially as the cross section shape is shown in the Labeda U.S. Pat. No. 3,860,293, and a hardness of Shore A89, then curves such as indicated at 42 and 44 will be obtained. Compared with these curves the skate wheel of the present invention having a hardness of Shore A89 and exhibits for two sizes, the curves 41 and 41' in FIG. 3 and the shaded area between the curves is the critical area. Mathematically, we find that the slope is in the critical area at 25*a* of the wheel, delineated substantially from the end of the bearing at 1.000 of an inch outward where deflection to distances is considered, distance being inches on the horizontal X axis and deflection being in inches on the vertical Y axis. Comparing the performance of the instant invention with the parabolic counterbore, the curve 40 exhibits a slope or trigonometric tangent along this line of approximately 5 while the slope of curve 42 is approximately 11. This illustrates the variations which are apparent in the art and show the differences as compared to the applicant's invention having a hardness of Shore A89 which are illustrated in two sizes by curves 41, 41' of a slope or trigonometric tangent of between 6 to 8 shown by the shaded area in FIG. 3** beyond the bearing designated at 1.000 of an inch. The inventor has found that similar results may be obtained with wheels having a range of between Shore A88 to A91.

Figure 5:
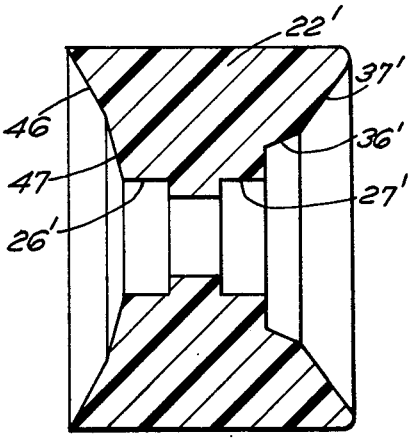
FIG. 5 is an elevational view in section of a modified wheel.

In FIG. 5 there is illustrated a wheel of slightly modified construction which changes are dictated by wheels of large axial dimension and large diameter. For example, the wheels are shown in FIGS. 1 and 2 have a diameter on the order of $1\frac{7}{8}$ inch and an axial dimension on the order of $1\frac{5}{8}$ inches whereas the larger wheel of FIG. 5 is on the order of 2 11/16 diameter and an axial dimension on the order of 2 inches. At times it is necessary to construct wheels of a larger diameter and axial length in which the parameters are changed to a sufficient degree where it is necessary to control the deflection on the inner end face of the wheel. To provide the proper characteristics a counterbore is formed on the inner face of the wheel structure. The wheel 22' will be provided with the usual outer counterbores 36' and 37' and now will have the inner counterbores 46 and 47. The counterbore 46 has an identical angular construction as the counterbore 37', that is to say, it extends at an angle of 60° to the axis, while the counterbore 47 is at an angle of approximately 75°. In this way the inner edge of the wheel will exhibit certain deflection characteristics similar to that as described in connection with the previous embodiments so that the larger structure will now exhibit superior tracking ability due to the deflection that takes place at the inner edge as well as the outer edge.

I claim:

1. A wheel for use in a roller skate or the like having an axle, said wheel comprising a cylindrical body consisting of resilient plastic material having an axial opening for receiving said axle, said cylindrical body having opposed ends, bearing means comprising a pair of spaced bearings received within the axial opening and situated closer to one of said ends than the other of said ends of said cylindrical body, said body being formed with a recessed area comprising a series of at least two adjoining tapered substantially straight sided annular counterbores extending a major portion of the distance from said other end of said body into the area of the bearing means, said outer counterbore having a greater angle with the rotational axis than the inner counterbore, said recessed area from said bearing means to said other end exhibiting an axial distance to deflection slope characteristic outwardly from said bearing of between 6 to 8, said recessed portion being capable of resiliently flexing and situated in its entirety beyond the bearing means carried within the cylindrical body.

2. The wheel of claim 1 wherein said tapered counterbores taper outwardly away from the bearing at the end of the axle.

3. The wheel of claim 2 wherein a second series of tapered substantially straight sided annular counterbores is provided at the other end of said bore and will face the inner portion of the axle.

* * * * *